US009039147B2

(12) United States Patent
Koike et al.

(10) Patent No.: US 9,039,147 B2
(45) Date of Patent: May 26, 2015

(54) LIQUID FEED VALVE UNIT AND LIQUID EJECTION DEVICE

(75) Inventors: Kaoru Koike, Nagano (JP); Toshio Kumagai, Nagano (JP); Kazutoshi Shimizu, Shimosuwa-machi (JP)

(73) Assignee: Seiko Epson Corporation, Tokyo (JP)

( * ) Notice: Subject to any disclaimer, the term of this patent is extended or adjusted under 35 U.S.C. 154(b) by 98 days.

(21) Appl. No.: 13/293,238

(22) Filed: Nov. 10, 2011

(65) Prior Publication Data

US 2012/0127242 A1 May 24, 2012

(30) Foreign Application Priority Data

Nov. 19, 2010 (JP) ..... 2010-259180

(51) Int. Cl.
*B41J 2/175* (2006.01)

(52) U.S. Cl.
CPC ..... *B41J 2/17509* (2013.01); *B41J 2/175* (2013.01); *B41J 2/17596* (2013.01)

(58) Field of Classification Search
CPC ..... B41J 2/17596; B41J 2002/16594; B41J 2202/05; B41J 2/175; B41J 2/17559; B41J 2/17556
USPC ..... 347/20, 85, 86, 30, 92, 93
See application file for complete search history.

(56) References Cited

U.S. PATENT DOCUMENTS 4,372,208 A * 2/1983 Legardinier ..... 101/366
4,520,369 A * 5/1985 Shackleton ..... 347/85
4,558,326 A * 12/1985 Kimura et al. ..... 347/30
6,183,078 B1 * 2/2001 Pietrzyk et al. ..... 347/85
6,267,568 B1 * 7/2001 Pagnon et al. ..... 417/403
7,156,507 B2 1/2007 Aruga et al.
7,163,282 B2 1/2007 Kumagai et al.
7,278,718 B2 10/2007 Aruga et al.
7,780,277 B2 * 8/2010 Aruga et al. ..... 347/85
2001/0017641 A1 * 8/2001 Kobayashi et al. ..... 347/85
2001/0019347 A1 * 9/2001 Hauck ..... 347/86
2005/0057626 A1 * 3/2005 Usui et al. ..... 347/86
2005/0062809 A1 * 3/2005 Yoshino et al. ..... 347/85
2006/0061639 A1 * 3/2006 Yoshino et al. ..... 347/85
2007/0115333 A1 * 5/2007 Aruga et al. ..... 347/85
2007/0126822 A1 * 6/2007 Silverbrook et al. ..... 347/86
2007/0126844 A1 * 6/2007 Silverbrook et al. ..... 347/108

(Continued)

FOREIGN PATENT DOCUMENTS

JP 2005-095861 A 4/2005
JP 4155324 B2 9/2008

(Continued)

*Primary Examiner* — Matthew Luu
*Assistant Examiner* — Patrick King
(74) *Attorney, Agent, or Firm* — Global IP Counselors, LLP

(57) ABSTRACT

A liquid feed valve unit is configured to switch between a releasing mode for forcibly opening a valve and a blocking mode for closing the valve, and the valve can therefore be opened and closed in a short time as needed. Since the releasing mode is implemented by pushing the peripheral part and the pressure-receiving part of the flexible member, the flexible member can be prevented from flexing toward the outside of the liquid accommodating chamber even in the case that the pressure-receiving part is pushed. In this case, since a residual pressure can be prevented from forming in the liquid accommodating chamber, there is no need to suspend operation, and it is possible to immediately proceed to the next operation. A fast-operating liquid feed valve unit can thereby be obtained.

19 Claims, 7 Drawing Sheets

(56) References Cited

U.S. PATENT DOCUMENTS

| | | | | |
|---|---|---|---|---|
| 2008/0148859 | A1* | 6/2008 | Aoki et al. | 73/723 |
| 2008/0231671 | A1* | 9/2008 | Lee et al. | 347/85 |
| 2009/0073243 | A1* | 3/2009 | Nakamura | 347/85 |
| 2009/0179969 | A1* | 7/2009 | Hibbard et al. | 347/85 |
| 2009/0237426 | A1* | 9/2009 | Kimura | 347/7 |
| 2010/0271447 | A1* | 10/2010 | Aruga et al. | 347/87 |

FOREIGN PATENT DOCUMENTS

| | | | |
|---|---|---|---|
| JP | 2009-178889 | A | 8/2009 |
| JP | 2010-120249 | A | 6/2010 |

* cited by examiner

LIQUID FEED VALVE UNIT AND LIQUID EJECTION DEVICE

CROSS-REFERENCE TO RELATED APPLICATIONS

This application claims priority to Japanese Patent Application No. 2010-259180 filed on Nov. 19, 2010. The entire disclosure of Japanese Patent Application No. 2010-259180 is hereby incorporated herein by reference.

BACKGROUND

1. Technical Field

The present invention relates to a liquid feed valve unit and a liquid ejection device.

2. Related Art

Inkjet printing devices (hereinafter referred to as "printing devices"), for example, and the like are known as liquid ejection devices for ejecting a liquid. A printing device is a device for recording characters, images, and the like on a recording medium. A printing device is configured so that ink is ejected to a recording medium from a nozzle provided to an ejection head. The ejection head is mounted to a carriage, for example, or other movement mechanism, and is configured so as to eject ink while moving over the recording medium.

In a printing device of the type referred to as "off carriage," an ink cartridge is disposed on the case side of the device, and ink is fed to an ejection head via a feed tube from the ink cartridge. Such a printing device has an ink feed valve unit on the carriage side, and the ink feed valve unit has self-sealing functionality (see Japanese Laid-Open Patent Publication No. 2009-178889, for example).

The ink feed valve unit is provided with an ink feed chamber and a pressure chamber. The ink fed from the ink cartridge is fed to the ejection head through the pressure chamber from the ink feed chamber. A movable valve is provided between the ink feed chamber and the pressure chamber, and the ink feed chamber and the pressure chamber are communicated and non-communicated by the opening and closing of the movable valve. The ink feed valve unit is configured so that a reduction in the amount of ink inside the pressure chamber causes a film member which constitutes a portion of the pressure chamber to change position, and this position change is directly transmitted to the movable valve, thereby operating the movable valve. A configuration has recently been adopted in which a plate-shaped pressure-receiving part is attached to the center part of the film member, the pressure-receiving part is pushed toward the pressure chamber to push the movable valve, and the movable valve is thereby opened.

When ink is consumed by the ejection head, the amount of ink in the pressure chamber decreases and the pressure of the pressure chamber decreases. The movable valve opens when the pressure of the pressure chamber decreases, and ink is fed to the pressure chamber from the ink feed chamber. An amount of ink corresponding to the amount of ink consumed in the ejection head is fed to the pressure chamber. Pressure upstream from the ink feed valve unit therefore does not affect the ejection head side.

SUMMARY

However, in the configuration described above, when the pressure-receiving part is pushed toward the pressure chamber, the pressure of the pressure chamber increases, and the film member on the periphery of the pressure-receiving part flexes toward the outside of the pressure chamber. When pushing by the pressure-receiving part is removed in this state, the pressure with which the portion of the film member flexed toward the outside returns to the inside becomes a residual pressure, and this residual pressure sometimes causes ink to leak from the ejection head. Problems therefore arise in that it is necessary to wait until the residual pressure is removed before proceeding to the next operation, and operation takes time.

In view of the foregoing, an object of the present invention is to provide a fast-operating liquid feed valve unit and liquid ejection device.

A liquid feed valve unit according to one aspect of the present invention is a liquid feed value unit for feeding a liquid from a liquid storing part for storing the liquid to a liquid ejection head for ejecting the liquid. The liquid feed valve unit includes a liquid accommodating member, a flexible member, a valve, an urging mechanism, a pushing mechanism and a control unit. The liquid accommodating member has a concave part forming a liquid accommodating chamber connected to the liquid ejection head and the liquid storing part. The flexible member blocks an opening of the concave part. The valve is configured and arranged to block a connecting passage between the liquid accommodating chamber and the liquid storing part, and to open the connecting passage when the flexible member flexes in a direction in which an internal volume of the liquid accommodating chamber decreases. The urging mechanism urges the valve so that the valve opens the connecting passage in a reduced-pressure state in which a pressure in the liquid accommodating chamber is less than a predetermined pressure, and so that the valve blocks the connecting passage in a state other than the reduced-pressure state. The pushing mechanism is provided to a portion of the flexible member, and configured and arranged to push a pressure-receiving part and a peripheral part of the flexible member around the pressure-receiving member, the pressure receiving part being configured and arranged to receive a pressure from the valve when the valve contacts the flexible member. The control unit is configured to switch between operating in a releasing mode for pushing the peripheral part and the pressure-receiving part to forcibly open the valve, and a blocking mode for air-releasing the peripheral part and the pressure-receiving part to close the valve.

According to this aspect, a configuration is adopted of switching between a releasing mode for forcibly opening the valve, and a blocking mode for closing the valve, and the valve can therefore be opened and closed in a short time as needed. Moreover, in the present invention, since the releasing mode is implemented by simultaneously pushing the peripheral part and the pressure-receiving part of the flexible member, the flexible member can be prevented from flexing toward the outside of the liquid accommodating chamber even in the case that the pressure-receiving part is pushed. In this case, since a residual pressure can be prevented from forming in the liquid accommodating chamber, there is no need to suspend operation, and it is possible to immediately proceed to the next operation. A fast-operating liquid feed valve unit can thereby be obtained.

With the liquid feed valve unit described above, the pushing mechanism preferably has an expansion and contraction mechanism configured and arranged to expand and contract, and to push the peripheral part and the pressure-receiving part in an expanded state, and the control unit is preferably configured to cause the expansion and contraction mechanism to expand to implement the releasing mode, and to cause the expansion and contraction mechanism to contract to implement the blocking mode.

According to this aspect, a configuration is adopted in which the pushing mechanism has an expansion and contraction mechanism formed so as to be able to expand and contract, and capable of pushing the peripheral part and the pressure-receiving part in an expanded state, and the control unit implements the releasing mode by expanding the expansion and contraction mechanism, and implements the blocking mode by contracting the expansion and contraction mechanism. The valve can therefore be opened and closed in a short time.

With the liquid feed valve unit described above, the pushing mechanism preferably has a pressure adjustment chamber surrounded by a wall part so as to be adjacent to the peripheral part and the pressure-receiving part, and a pressure adjustment part configured and arranged to adjust a pressure in the pressure adjustment chamber. The control unit is preferably configured to control the pressure adjustment part to switch between the releasing mode and the blocking mode.

According to this aspect, a configuration is be adopted in which the pushing mechanism has a pressure adjustment chamber surrounded by a wall part so as to be adjacent to the peripheral part the pressure-receiving part; and a pressure adjustment part for adjusting the pressure of the pressure adjustment chamber; and the control unit switches between the releasing mode and the blocking mode by controlling the pressure adjustment part. The valve can therefore be opened and closed in a short time.

A liquid ejection device according to another aspect of the present invention includes the liquid feed valve unit as described above, and the liquid ejection head configured and arranged to eject the liquid.

According to this aspect, since the fast-operating liquid feed valve unit described above is used as the liquid feed valve unit, it is possible to obtain a liquid ejection device having minimal operating delay.

The liquid ejection device described above preferably further includes a device control unit configured and arranged to switch between performing an ejection operation for ejecting the liquid from the liquid ejection head and an adjustment operation for adjusting an ejection state of the liquid ejection head. The device control unit preferably serves as the control unit of the liquid feed valve unit.

According to this aspect, the liquid ejection device further comprises a device control unit for switching between performing an ejection operation for ejecting the liquid from the liquid ejection head, and an adjustment operation for adjusting an ejection state of the liquid ejection head, and the device control unit serves as the control unit of the liquid feed valve unit. Efficient control is therefore possible.

With the liquid ejection device described above, the device control unit preferably implements the releasing mode in the liquid feed valve unit in a case in which an inside portion of the liquid ejection head is pressurized and the liquid is discharged as the adjustment operation.

According to this aspect, since the device control unit implements the releasing mode in the liquid feed valve unit in a case in which the inside of the liquid ejection head is pressurized and the liquid is discharged as the adjustment operation. The valve can be released in a short time without a residual pressure occurring in the liquid accommodating chamber.

With the liquid ejection device described above, the device control unit preferably implements the blocking mode in the liquid feed valve unit in a case in which an inside portion of the liquid ejection head is suctioned and the liquid is discharged as the adjustment operation.

According to this aspect, since the device control unit implements the blocking mode in the liquid feed valve unit in a case in which the inside of the liquid ejection head is suctioned and the liquid is discharged as the adjustment operation, no residual pressure occurs, and there is therefore no need to suspend operation, and the valve can be released in a short time.

BRIEF DESCRIPTION OF THE DRAWINGS

Referring now to the attached drawings which form a part of this original disclosure.

DETAILED DESCRIPTION OF EXEMPLARY EMBODIMENTS

Embodiments of the present invention will be described with reference to the drawings.

Figure 1:
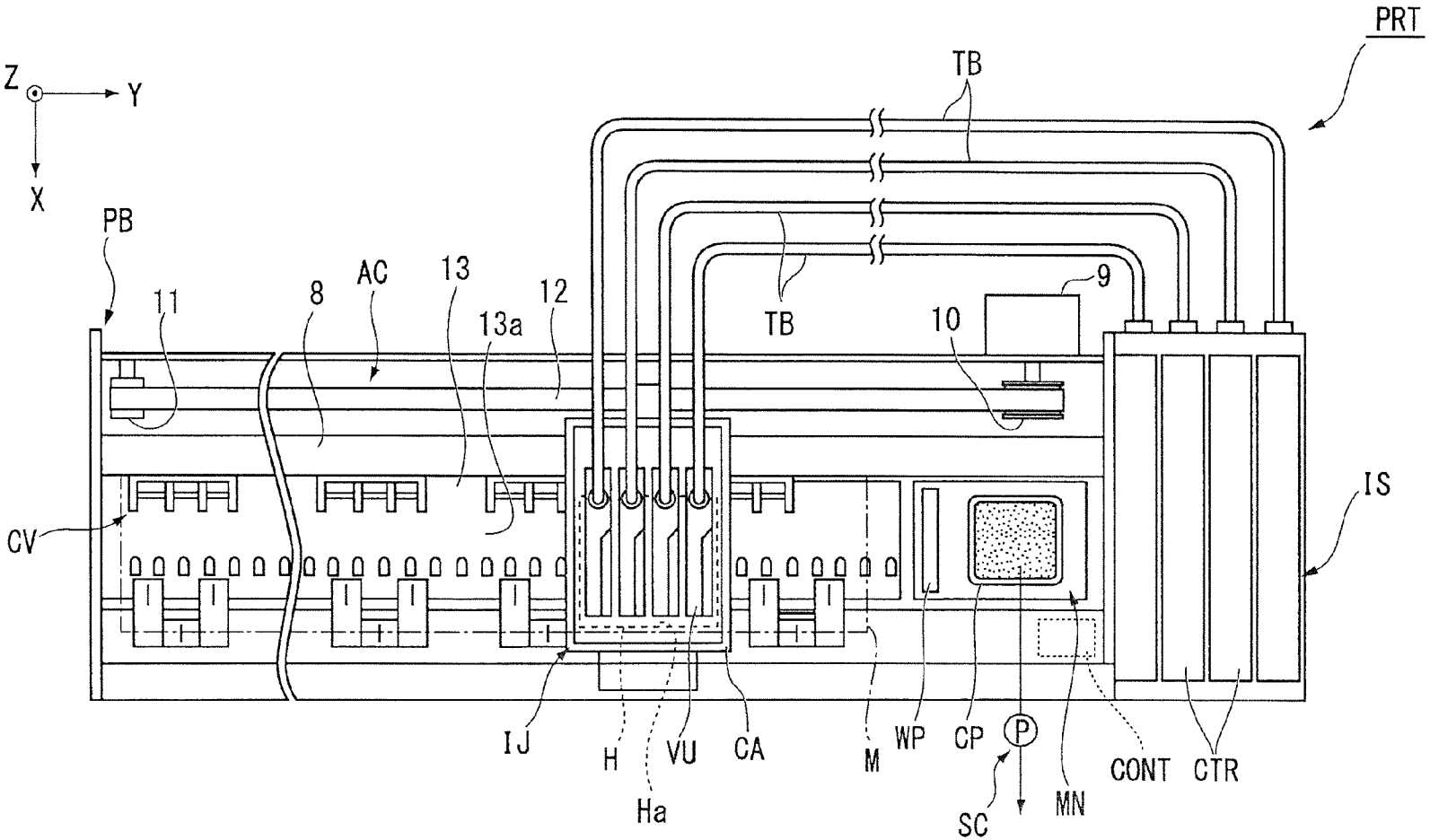
FIG. 1 is a schematic view showing the configuration of the printing device according to an embodiment of the present invention.

FIG. 1 is a view showing the overall configuration of the printing device PRT (liquid ejection device) according to the present embodiment. In the present embodiment, an inkjet-type printing device will be described as an example of the printing device PRT.

The printing device PRT shown in FIG. 1 is a device for performing print processing while conveying a paper, plastic sheet, or other sheet-shaped medium M. The printing device PRT is provided with a housing PB; an inkjet mechanism IJ for ejecting ink to the medium M; an ink feeding mechanism IS for feeding the ink to the inkjet mechanism IJ; a conveyance mechanism CV for conveying the medium M; a maintenance mechanism MN for performing maintenance of the inkjet mechanism IJ; and a control device CONT for controlling each mechanism.

An XYZ orthogonal coordinate system is set up for the following description, and the positional relationship of each constituent element will be described with appropriate reference to the XYZ orthogonal coordinate system. In the present embodiment, the conveyance direction of the medium M is designated as the X direction, the direction orthogonal to the X direction in the conveyance plane of the medium M is designated as the Y direction, and the direction perpendicular to the plane of the X and Y axes is designated as the Z direction. The rotation direction about the X axis is the θX direction, the rotation direction about the Y axis is the θY direction, and the rotation direction about the Z axis is the θZ direction.

The housing PB is formed so that the longitudinal direction thereof is the Y direction. The inkjet mechanism IJ, the ink feeding mechanism IS, the conveyance mechanism CV, the maintenance mechanism MN, and the control device CONT are attached to the housing PB. The housing PB is provided with a platen 13. The platen 13 is a support member for supporting the medium M. The platen 13 is disposed in the center part of the housing PB in the X direction thereof. The platen 13 has a flat surface 13*a* facing in the +Z direction. The flat surface 13*a* is used as a support surface for supporting the medium M.

The conveyance mechanism CV has a conveyance roller and/or a motor or the like for driving the conveyance roller. The conveyance mechanism CV conveys the medium M to the inside of the housing PB from the −X side of the housing PB and discharges the medium M to the outside of the housing PB from the +X side of the housing PB. The conveyance mechanism CV conveys the medium M inside the housing PB so that the medium M passes over the platen 13. The conveyance timing, conveyance amount, and other parameters of the conveyance mechanism CV are controlled by the control device CONT.

The inkjet mechanism IJ has a head H for ejecting ink, and a head movement mechanism AC for retaining and moving the head H. The head H ejects the ink toward the medium M that is sent over the platen 13. The head H has an ejection surface Ha for ejecting the ink. The ejection surface Ha faces the Z direction, and is disposed so as to face the flat surface 13*a* of the platen 13.

The head movement mechanism AC has a carriage CA. The head H is fixed to the carriage CA. The carriage CA is in contact with a guide shaft 8 suspended in the longitudinal direction (Y direction) of the housing PB. The head H and the carriage CA are disposed in the +Z direction of the platen 13.

Besides the carriage CA, the head movement mechanism AC has a pulse motor 9; a drive pulley 10 rotationally driven by the pulse motor 9; a free-rotating pulley 11 provided on the opposite side from the drive pulley 10 in the width direction of a printer body 5; and a timing belt 12 passed between the drive pulley 10 and the free-rotating pulley 11 and connected to the carriage CA.

The carriage CA is connected to the timing belt 12. The carriage CA is provided so as to be able to move in the Y direction in conjunction with the rotation of the timing belt 12. As the carriage CA moves in the Y direction, the carriage CA is guided by the guide shaft 8.

The ink feeding mechanism IS feeds ink to the head H. A plurality of ink cartridges CTR is accommodated by the ink feeding mechanism IS. The printing device PRT of the present embodiment is configured so that the ink cartridges CTR are accommodated in a position other than that of the head H (as an off-carriage-type printing device). The ink feeding mechanism IS has feed tubes TB for connecting the head H and the ink cartridges CTR. The ink feeding mechanism IS has a pump mechanism (not shown) for feeding the ink stored in the ink cartridges CTR to the head H via the feed tubes TB.

The maintenance mechanism MN is disposed at a home position of the head H. The home position is set outside the region in which printing is applied to the medium M. In the present embodiment, the home position is set on the +Y side of the platen 13. The home position is the location at which the head H stands by at such times as when the power to the printing device PRT is off or no recording is performed for a long time.

The maintenance mechanism MN has a capping mechanism CP for covering the ejection surface Ha of the head H, a wiping mechanism WP for wiping the ejection surface Ha, and other components. A suction pump or other suction mechanism SC is connected to the capping mechanism CP. The suction mechanism SC enables the capping mechanism CP to suction the air on the ejection surface Ha while covering the ejection surface Ha. The waste ink discharged toward the maintenance mechanism MN from the head H is recovered in a waste liquid recovery mechanism (not shown).

Figure 2:
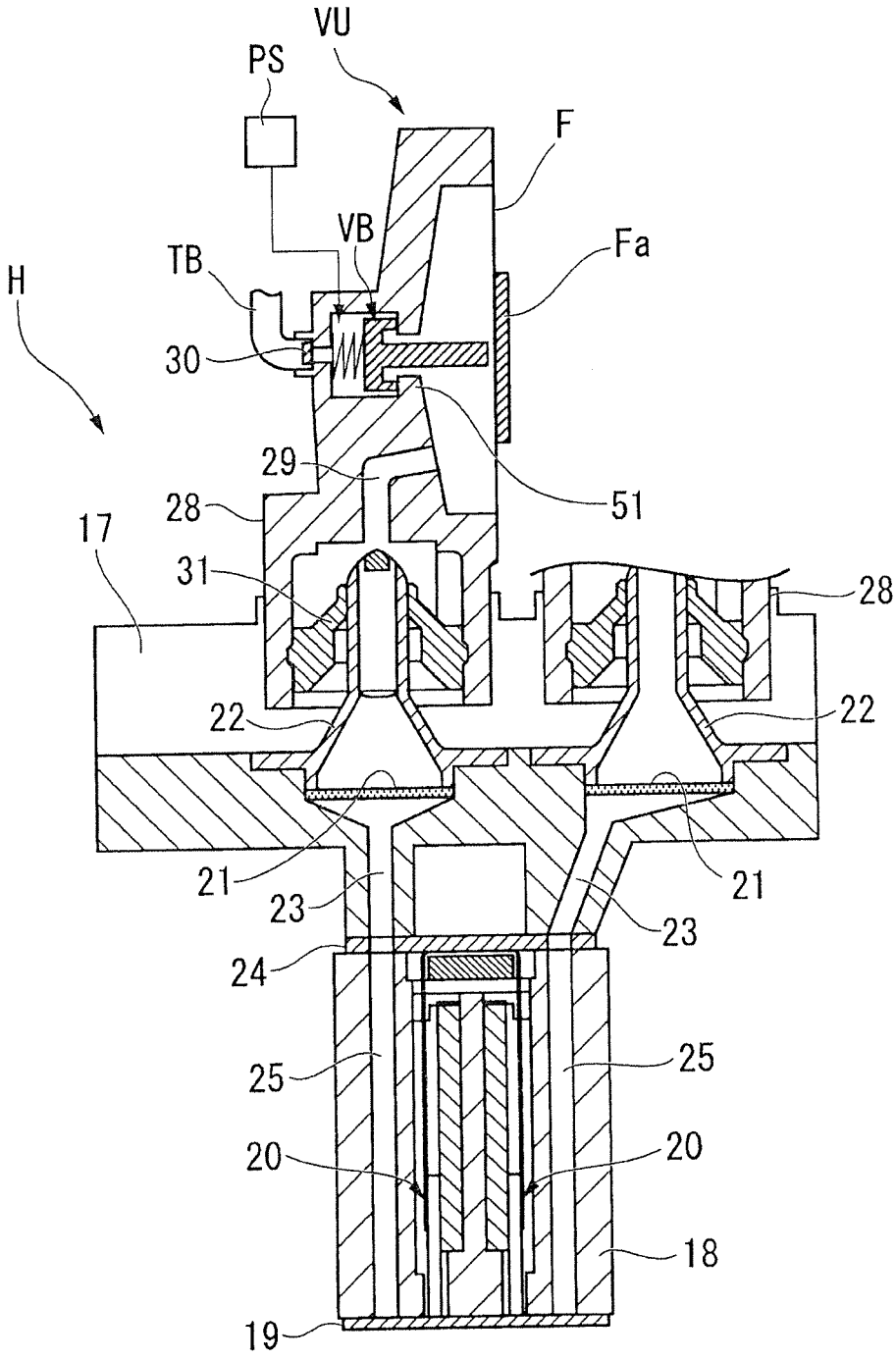
FIG. 2 is a schematic sectional view showing the configuration of the head according to the present embodiment.
Figure 3:
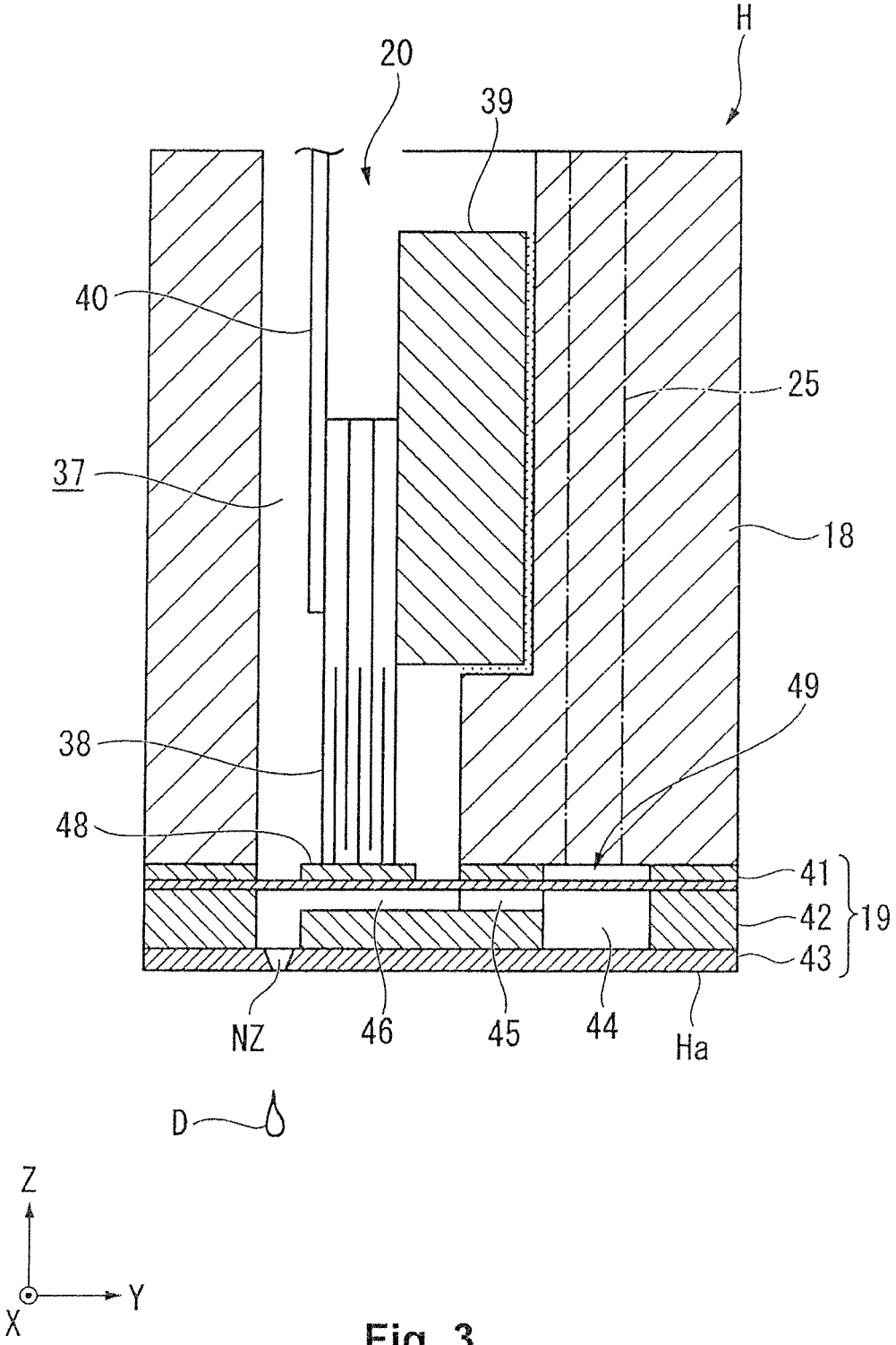
FIG. 3 is a schematic sectional view showing the configuration of the head according to the present embodiment.

FIG. 2 is a lateral sectional view showing the configuration of the head H. FIG. 3 is a sectional view showing the relevant parts of the configuration of the head H.

As shown in FIG. 2, the head H is provided with an introducer needle unit 17, a head case 18, a flow channel unit 19, and an actuator unit 20.

Two ink introducer needles 22 with filters 21 placed therein are attached parallel to each other on a top surface of the introducer needle unit 17. In introduction channels 23 corresponding to the ink introducer needles 22 are formed inside the introducer needle unit 17. Top ends of the ink introduction channels 23 are connected to the ink introducer needles 22 via the filters 21. Bottom ends of the ink introduction channels 23 are connected to case flow channels 25 inside the head case 18 via a gasket 24. A valve unit VU (one example of the liquid feed valve unit) is installed on each of the ink introducer needles 22.

Each valve unit VU is connected to a needle connector 28. The needle connectors 28 are portions for connecting the valve units VU and the ink introducer needles 22. A connection flow channel 29 connected to the needle connector 28 is formed in each valve unit VU. A seal member 31 in which the ink introducer needle 22 is fitted with substantially no gap is provided in the internal space of the needle connector 28. Fitting the ink introducer needle 22 in the seal member 31 forms a connection in which there is substantially no leakage between the valve unit VU and the introducer needle unit 17.

As shown in FIG. 3, the head case 18 is formed by using synthetic resin or the like. The head case 18 is formed in a box shape having a hollow part, for example. The introducer needle unit 17 is attached to a top end side of the head case 18 via the gasket 24. A flow channel unit 19 is joined to a bottom end surface of the head case 18. The actuator unit 20 is accommodated inside a hollow part 37 formed inside the head case 18.

The case flow channels 25 are provided so as to pass through the inside of the head case 18 in the height direction. Top ends of the case flow channels 25 are communicated with the ink introduction channels 23 of the introducer needle unit 17 via the gasket 24. Bottom ends of the case flow channels 25 are communicated with a shared ink chamber 44 inside the flow channel unit 19. Therefore, ink D introduced from the ink introducer needles 22 is fed toward the shared ink chamber 44 through the ink introduction channels 23 and the case flow channels 25.

The actuator unit 20 has a plurality of piezoelectric vibrators 38 disposed in a comb pattern, for example; a stationary plate 39 for retaining the piezoelectric vibrators 38; and a flexible cable 40 for feeding drive signals from the control device CONT to the piezoelectric vibrators 38.

The piezoelectric vibrators 38 are fixed so that the end parts thereof at the bottom in the drawing protrude from a bottom end surface of the stationary plate 39. The piezoelectric vibrators 38 are attached on the stationary plate 39 in a so-called cantilever state. The stationary plate 39 for supporting the piezoelectric vibrators 38 is composed of stainless steel having a thickness of about 1 mm, for example. The surfaces of the stationary plate 39 other than the surface to which the piezoelectric vibrators 38 are fixed, for example, are bonded to inside wall surfaces of the case which form the boundaries of the hollow part 37.

The flow channel unit 19 has a diaphragm 41, a flow channel base plate 42, and a nozzle base plate 43. The diaphragm 41, the flow channel base plate 42, and the nozzle base plate 43 are bonded together in a laminated state. The flow channel unit 19 constitutes a continuous ink flow channel (liquid flow channel) from the shared ink chamber 44 to a nozzle NZ through an ink feed port 45 and a pressure chamber 46. The pressure chamber 46 is formed so that the direction orthogonal to the arrangement direction of the nozzle NZ (nozzle row direction) is the longitudinal direction.

The shared ink chamber 44 is connected to the case flow channels 25. The shared ink chamber 44 is a chamber to which the ink D from the ink introducer needles 22 is introduced. The shared ink chamber 44 is connected to the ink feed port 45. The ink D introduced to the shared ink chamber 44 is distributed to each pressure chamber 46 through the ink feed port 45.

The nozzle base plate 43 is disposed at a bottom part of the flow channel unit 19. A plurality of nozzles NZ is formed in the nozzle base plate 43 at a pitch (e.g., 180 dpi) corresponding to the dot formation density of an image or the like formed on the medium M. A stainless steel, for example, or other metal plate is used as the nozzle base plate 43.

Figure 4:
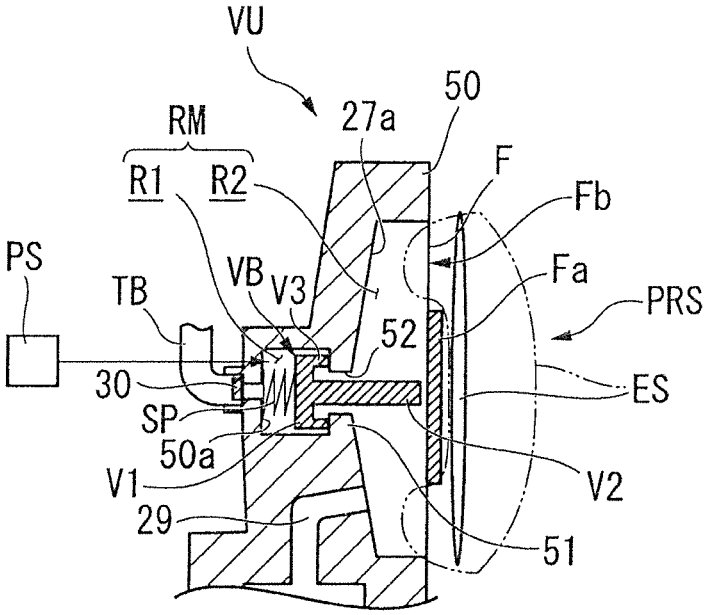
FIG. 4 is a sectional view showing the configuration of the valve unit according to the present embodiment.

FIG. 4 is a sectional view showing the detailed configuration of the valve unit VU.

As shown in FIG. 4, the valve unit VU has an accommodating chamber formation member 50 (one example of the liquid accommodating member) formed by using polypropylene, for example, or another resin material. An ink accommodating chamber RM (one example of the liquid accommodating chamber) is formed inside the accommodating chamber formation member 50. A partitioning part 51 is formed at the center of the accommodating chamber formation member 50 in the left-right direction of the drawing. The ink accommodating chamber RM is partitioned into a first chamber (concave part) R1 and a second chamber R2 by the partitioning part 51.

A communicating part 52 is formed in the partitioning part 51. The first chamber R1 of the ink accommodating chamber RM is connected to the ink feeding mechanism IS via the feed tube TB. The second chamber R2 is connected to the head H via the connection flow channel 29. The first chamber R1 and the second chamber R2 are communicated via the communicating part 52. Communication from the ink feeding mechanism IS to the head H thus occurs in the following order: ink feeding mechanism IS, feed tube TB, first chamber R1, communicating part 52, second chamber R2, connection flow channel 29, and head H.

An opening is formed in the portion (right side in FIG. 4) other than the partitioning part 51 among the wall parts surrounding the second chamber R2 of the accommodating chamber formation member 50. The opening is formed so as to communicate the second chamber R2 and the outside of the ink accommodating chamber RM. A flexible member F is affixed to the opening, and the opening is blocked by the flexible member F. A film or the like formed by resin, for example, or the like may be used as the flexible member F. A pressure-receiving plate Fa (one example of the pressure-receiving part) is provided to the flexible member F. The pressure-receiving plate Fa is attached in the center of the flexible member F. Consequently, when the opening is viewed from the outside, a peripheral part Fb of the flexible member F is exposed on the periphery of the pressure-receiving plate Fa.

A valve VB is provided extending into the first chamber R1 and the second chamber R2. The valve VB has a flange part V1 and a shaft part V2. The flange part V1 is provided inside the first chamber R1. A seal part V3 for closing off the communicating part 52 is formed in the flange part V1. The communicating part 52 is blocked by the seal part V3 making contact with the partitioning part 51. The shaft part V2 is disposed so as to pass through the communicating part 52. In the shaft part V2, an end part on the opposite side from the flange part V1 is disposed facing the flexible member F of the second chamber R2.

An urging mechanism SP is disposed between the flange part V1 and a wall surface 50*a* on the left side of the first chamber R1 in FIG. 4. A spring member or the like is suitable for use as the urging mechanism SP. The urging mechanism SP urges the flange part V1 toward the second chamber R2 with a predetermined urging force. Through this urging force, a state is maintained in which the seal part V3 is brought into contact with the partitioning part 51 (the communicating part 52 is blocked).

When the flexible member F is flexed in the direction in which the internal volume of the ink accommodating chamber RM decreases (direction in which the second chamber R2 is narrowed), the flexible member F and the pressure-receiving plate Fa push the end part of the shaft part V2 in the direction from the second chamber R2 toward the first chamber R1. When this pushing force becomes greater than the urging force by the urging mechanism SP, the seal part V3 is moved in the direction away from the partitioning part 51, and the communicating part 52 is opened.

Consequently, by appropriately setting the urging force of the urging mechanism SP, a configuration is achieved in which the seal part V3 opens the communicating part 52 when the pressure of the ink accommodating chamber RM is less than a predetermined pressure, and the seal part V3 can block the communicating part 52 at all other times. The predetermined pressure may be atmospheric pressure, for example, or another pressure, and a pressure in the ink accommodating chamber RM less than the predetermined pressure may be caused by such factors as a negative pressure due to ejection of ink in the ejection operation.

The operation in this case will be described. When ink is ejected from the head H in a state in which the seal part V3 is blocking the communicating part 52, the reduction of ink causes a negative pressure to occur in the flow channel from the second chamber R2 to the head H. This negative pressure causes the flexible member F to flex toward the inside of the second chamber R2. When the force with which the flexible member F and the pressure-receiving plate Fa push the shaft part V2 is greater than the urging force of the urging mechanism SP, the shaft part V2 is pushed toward the first chamber R1 and the communicating part 52 opens. Here, the pressure-receiving plate Fa functions as a receiving part when the shaft part V2 is pushed.

Since the first chamber R1 and the ink feeding mechanism IS are communicated, and the second chamber R2 and the head H are communicated, when the communicating part 52 for communicating the first chamber R1 and the second chamber R2 opens, ink is fed from the first chamber R1 through the communicating part 52 to the second chamber R2. By feeding of the ink, the negative pressure from the second chamber R2 to the head H decreases, and when the urging force of the urging mechanism SP becomes greater than the negative pressure, the urging force causes the seal part V3 to block the communicating part 52.

The valve unit VU thus has the function of creating a negative pressure in the head H from the second chamber R2 and adjusting the ink meniscus of the nozzle, and the function as a non-return valve (one-way valve) whereby the ink flows only in the direction from the first chamber R1 to the second chamber R2.

A pushing mechanism PRS is provided on the outside of the flexible member F. The pushing mechanism PRS has an air bag, for example, or other expansion and contraction mechanism. The expansion and contraction mechanism ES is connected to an air driving mechanism or the like not shown in the drawing. The expansion and contraction mechanism ES is configured so as to expand and contract by feeding of air or removal of air by the air driving mechanism.

In the expanded state of the expansion and contraction mechanism ES, the pressure-receiving plate Fa and the peripheral part Fb can be pushed toward the inside of the second chamber R2 at the same time, as indicated by the two-dot chain line in FIG. 4. In the contracted state of the expansion and contraction mechanism ES, the state of pushing on the pressure-receiving plate Fa and the peripheral part Fb is removed, and the pressure-receiving plate Fa and the peripheral part Fb are air-released.

As shown in FIG. 4 (or FIG. 2), a pressurizing mechanism PS is connected to the valve unit VU. The pressurizing mechanism PS is connected to the first chamber R1 of the ink accommodating chamber RM, and pressurizes the first chamber R1. The pressurizing mechanism PS pressurizes the first chamber R1 in a state in which the communicating part 52 is open, and ink can thereby be fed under pressure from the first chamber R1 to the second chamber R2.

Figure 5:
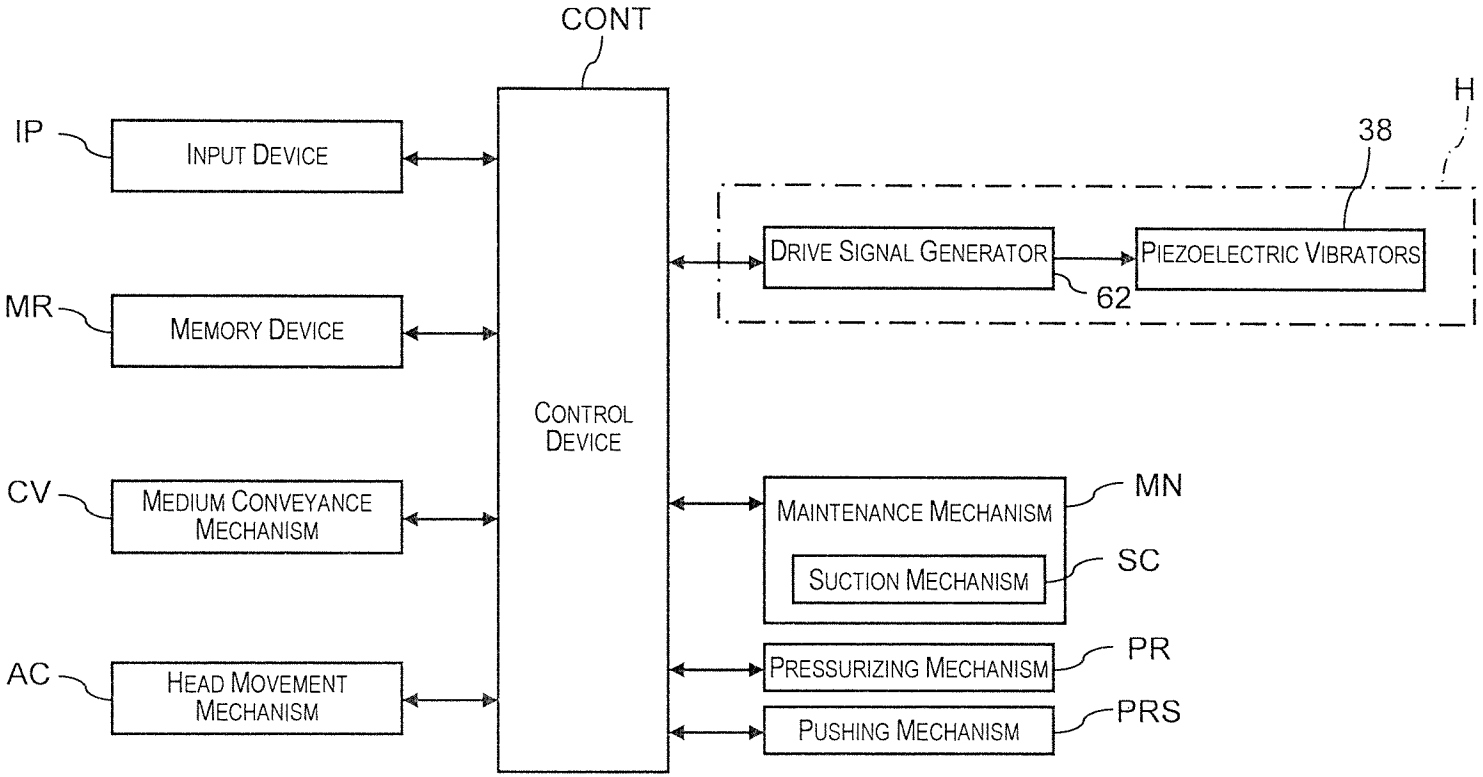
FIG. 5 is a block diagram showing the configuration of the control system according to the present embodiment.
Figure 6:
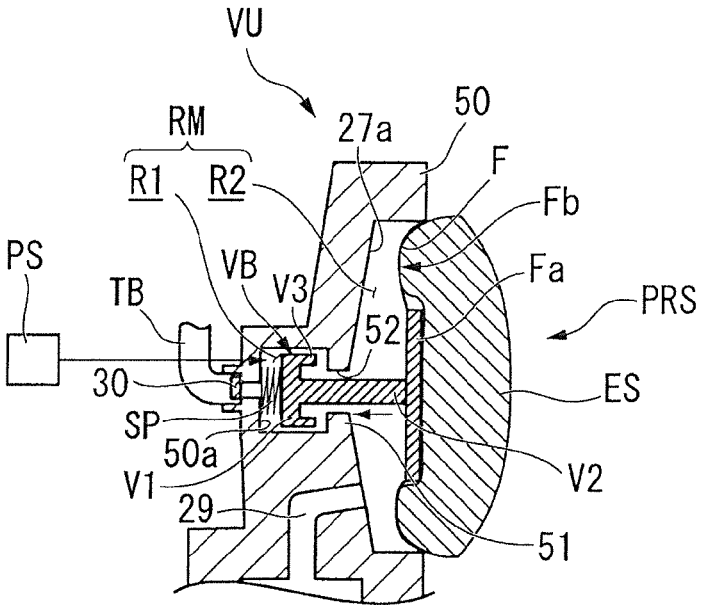
FIG. 6 is a view showing the operation of the printing device according to the present embodiment.

FIG. 5 is a block diagram showing the electrical configuration of the printing device PRT.

An input device IP for inputting various types of information relating to operation of the printing device PRT, a memory device MR for storing the various types of information relating to operation of the printing device PRT, and other components are connected to the control device CONT, and the conveyance mechanism CV, the head movement mechanism AC, the maintenance mechanism MN, and other components described above are also connected to the control device CONT. The control device CONT is capable of controlling the suction mechanism SC, for example, and other components of the maintenance mechanism MN. The control device CONT is also capable of controlling the operation of the pressurizing mechanism PS or pushing mechanism PRS described above, the expansion and contraction of the expansion and contraction mechanism ES, for example, and other operations. In the present embodiment, the control device CONT is configured so as to be able to control both the printing device PRT and the valve unit VU. Of course, a configuration may also be adopted in which a control unit for the printing device PRT and a control unit for the valve unit VU are separately provided.

The printing device PRT is provided with a drive signal generator 62 for generating a drive signal inputted to each of the piezoelectric vibrators 38. The drive signal generator 62 is connected to the control device CONT. Data indicating the voltage variation of a discharge pulse inputted to the piezoelectric vibrators 38 of the head H, and a timing signal for specifying the timing for varying the voltage of the discharge pulse are inputted to the drive signal generator 62. The drive signal generator 62 is provided so as to be capable of feeding a drive signal individually for each piezoelectric vibrator 38.

The operation of the printing device PRT configured as described above will next be described.

In the case of printing by the head H, the control device CONT places the medium M on the −Z side of the head H through use of the conveyance mechanism CV. After the medium M is placed, the control device CONT inputs a drive signal to the piezoelectric vibrators 38 from the drive signal generator 62 corresponding to the nozzles NZ on the basis of image data of the image to be printed.

When the drive signal is inputted to the piezoelectric vibrators 38, the piezoelectric vibrators 38 extend and retract. Through the extension and retraction of the piezoelectric vibrators 38, the volume of the pressure chamber 46 varies, and the pressure fluctuates in the pressure chamber 46 in which the ink is accommodated. Ink is ejected from the nozzles NZ by this fluctuation in pressure. The desired image is formed on the medium M by the ink ejected from the nozzles NZ.

When the ink ejection operation described above is performed, the control device CONT places the expansion and contraction mechanism ES in the contracted state and places the peripheral part Fb and pressure-receiving plate Fa of the flexible member F in the air-released state.

In order to maintain or restore satisfactory ejection characteristics in the head H, the control device CONT periodically performs a capping operation for covering the ejection surface Ha in which the nozzles NZ are formed, a flushing operation for discharging ink from the nozzles NZ, a suction operation, and other maintenance operations of the head H, for example.

In the case of the capping operation, for example, the control device CONT moves the head H to the home position and causes the head H and the capping mechanism CP to face each other. At the same time, the control device CONT moves the capping mechanism CP toward the head H and pushes on the ejection surface Ha through use of a drive mechanism not shown in the drawing. By this operation, a seal is formed between the capping mechanism CP and the ejection surface Ha.

Bubbles also sometimes form inside the shared ink chamber 44 of the head H, for example. When a bubble enters a nozzle NZ, for example, the meniscus inside the nozzle NZ is disrupted, and the ejection characteristics may be compromised. The control device CONT therefore performs an operation for causing the bubble to be discharged together with ink through use of the pressurizing mechanism PS, for example.

Figure 7:
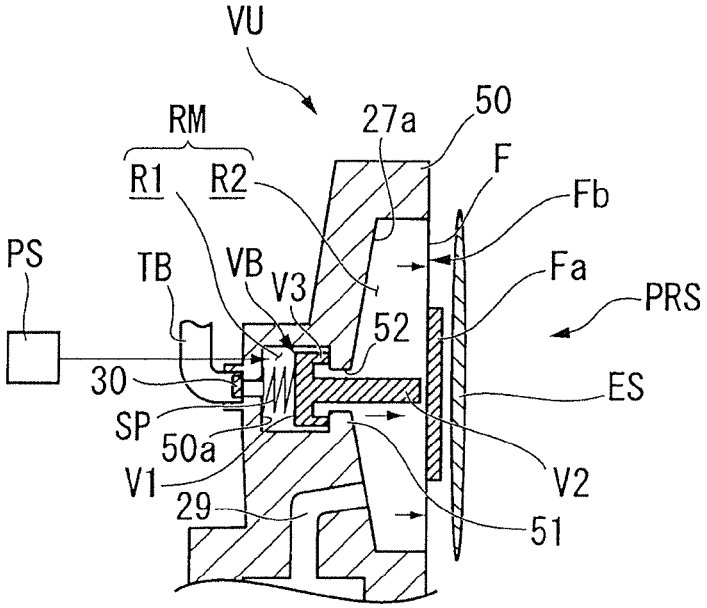
FIG. 7 is a view showing the operation of the printing device according to the present embodiment.

In this case, the control device CONT expands the expansion and contraction mechanism ES. Through this operation, the expansion and contraction mechanism ES pushes the peripheral part Fb and pressure-receiving plate Fa of the flexible member F toward the inside of the second chamber R2 at the same time. When this pushing force becomes greater than the urging force of the urging mechanism SP, the shaft part V2 is pushed into the first chamber R1 as shown in FIG. 7, the seal part V3 separates from the partitioning part 51, and the communicating part 52 is opened. In this state, since pressure is applied in the same manner to the peripheral part Fb as to the pressure-receiving plate Fa, the peripheral part Fb can be prevented from deforming to the outside.

After releasing (releasing mode) the communicating part 52, the control device CONT pressurizes the first chamber R1 through use of the pressurizing mechanism PS. By this operation, the ink flows through from the pressurized first chamber R1 to the second chamber R2 via the communicating part 52. The ink is fed to the head H from the second chamber R2, the bubble in the head H is pushed out to the Z side of the nozzle NZ, and the ink is discharged from the nozzle NZ together with the bubble. The ejection characteristics of the head H can thus be maintained.

Figure 8:
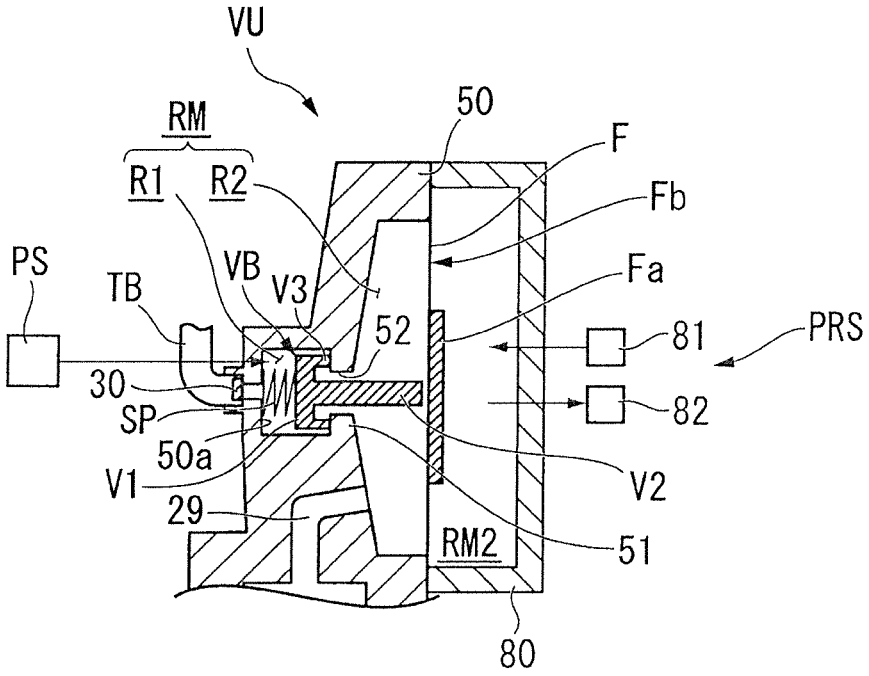
FIG. 8 is a view showing another configuration of the printing device according to the present invention.

When ending the ink discharge operation by pressurization, the control device CONT stops operation of the pressurizing mechanism PS and causes the expansion and contraction mechanism ES to contract. Through this operation, pressurization is released at the same time for the peripheral part Fb and the pressure-receiving plate Fa of the flexible member F. The pushing force on the peripheral part Fb and the pressure-receiving plate Fa decreases in conjunction with the contraction of the expansion and contraction mechanism ES, and when the pushing force becomes less than the urging force of the urging mechanism SP, the flange part V1 moves toward the second chamber R2. By this movement of the flange part V1, the seal part V3 makes contact with the partitioning part 51, and the communicating part 52 is blocked. When the expansion and contraction mechanism ES separates from the peripheral part Fb and the pressure-receiving plate Fa, the peripheral part Fb returns to the original state thereof without expanding to the outside, as shown in FIG. 8. It is therefore possible to immediately proceed to the next operation.

As the next operation, the control device CONT may perform the ink ejection operation described above, or a suction operation, for example. In the case of the suction operation, the control device CONT causes the suction operation to be performed in a state (blocking mode) in which the expansion and contraction mechanism ES is contracted. The control device CONT operates the suction mechanism SC after forming a seal between the head H and the capping mechanism CP. Through this operation, the inside of the capping mechanism CP communicated with the suction mechanism SC is suctioned to create a negative pressure. Ink is suctioned (discharged) from the nozzles NZ of the head H by the negative pressure formed between the head H and the capping mechanism CP. The appropriate viscosity of the ink in the nozzles NZ is therefore maintained.

The valve unit VU of the present embodiment described above is configured so as to switch between a releasing mode in which the communicating part 52 is forced open, and a blocking mode in which the communicating part 52 is closed. The communicating part 52 can therefore be opened and closed in a short time as needed. Moreover, in the present embodiment, since the releasing mode is implemented by simultaneously pushing the peripheral part Fb and the pressure-receiving plate Fa of the flexible member F, the peripheral part Fb can be prevented from flexing toward the outside of the second chamber R2 even in the case that the pressure-receiving plate Fa is pushed. In this case, since a residual pressure can be prevented from forming in the second chamber R2, there is no need to suspend operation, and it is possible to immediately proceed to the next operation. A fast-operating valve unit VU can thereby be obtained.

The technical scope of the present invention is not limited by the embodiment described above, and appropriate modifications are possible within the intended scope of the present invention.

For example, in the embodiment described above, a configuration is described in which an expansion and contraction mechanism ES is used as a pushing mechanism PRS for pushing the pressure-receiving plate Fa and the peripheral part Fb, but this configuration is not limiting.

For example, as shown in FIG. 8, a configuration may be adopted in which a pressure adjustment chamber RM2 surrounded by a wall part 80 so as to be adjacent to the peripheral part Fb and the pressure-receiving plate Fa, and a pressurizing part 81 (one example of the pressure adjustment part) and an air-release part 82 (one example of the pressure adjustment part) for adjusting the pressure of the pressure adjustment chamber RM2 are provided as a pushing mechanism PRS. In this configuration, the control device CONT can control the pressurizing part 81 and the air-release part 82 to switch between the releasing mode and the blocking mode. In this case as well, since the releasing mode is implemented by simultaneously pushing the peripheral part Fb and the pressure-receiving plate Fa of the flexible member F, the peripheral part Fb can be prevented from flexing toward the outside of the second chamber R2 even in the case that the pressure-receiving plate Fa is pushed. In this case, since a residual pressure can be prevented from forming in the second chamber R2, there is no need to suspend operation, and it is possible to immediately proceed to the next operation. Since the pressure adjustment chamber RM2 need only be air-released in the blocking mode, the control burden can be reduced.

In the embodiment described above, an inkjet-type printing device and an ink cartridge are employed, but a liquid ejection device for ejecting or discharging a liquid other than ink, and a liquid container which accommodates the liquid may also be employed. The present invention may also be applied to various types of liquid ejection devices which are provided with a liquid ejection head or the like for discharging minute droplets. The term "droplet" refers to the state of the liquid discharged from the liquid ejection device, and includes droplets which leave granular, teardrop-shaped, or filament-shaped traces.

The liquid referred to herein may be any material which can be ejected by the liquid ejection device. For example, the liquid is preferably in a state in which the material thereof is in the liquid phase, and includes not only fluids and materials that are liquid in one state thereof, such as high or low-viscosity liquids, sol/gel solutions, and other inorganic solvents, organic solvents, solutions, liquid resins, and liquid metals (metal liquids), but liquids in which particles of functional material composed of pigments, metal particles, and other solids are dissolved, dispersed, or mixed in a solvent. Ink, liquid crystal, or the like such as described in the embodiment above are cited as typical examples of the liquid. The term "ink" includes common water-based ink, oil-based ink, gel ink, hot-melt ink, and various other liquid compositions.

Specific examples of the liquid ejection device may include liquid ejection devices for ejecting liquid which includes electrode material, color material, or other material in dispersed or dissolved form for use in such applications as manufacturing liquid crystal displays, EL (electroluminescent) displays, surface-emitting displays, and color filters; liquid ejection devices for ejecting biological organic materials used to manufacture biochips; liquid ejection devices used as precision pipettes for ejecting liquids as test samples; and textile printing devices, microdispensers, and the like.

Liquid ejection devices for ejecting lubricating oil with pinpoint precision onto a clock, camera, or other precision machine; liquid ejection devices for ejecting UV-curing resin or other transparent resin liquids onto a substrate to form micro hemispherical lenses (optical lenses) used in an optical communication device or the like; and liquid ejection devices for ejecting acid or alkaline etching solution for etching a substrate or the like may be used. The present invention may be applied to any of these types of ejection devices and liquid containers.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A liquid feed valve unit for feeding a liquid from a liquid storing part for storing the liquid to a liquid ejection head for ejecting the liquid, the liquid feed valve unit comprising:

a liquid accommodating member having a concave part forming a liquid accommodating chamber communicating with the liquid ejection head, and communicating with the liquid storing part through a tube disposed between the liquid storing part and the liquid accommodating member;

a flexible member blocking an opening of the concave part;

a valve configured and arranged to block a connecting passage between the liquid accommodating chamber and the liquid storing part, and to open the connecting passage when the flexible member flexes in a direction in which an internal volume of the liquid accommodating chamber decreases, the valve being separate from the flexible member;

an urging mechanism urging the valve so that the valve opens the connecting passage in a reduced-pressure state in which a pressure in the liquid accommodating chamber is less than a predetermined pressure, and so that the valve blocks the connecting passage in a state other than the reduced-pressure state;

a pushing mechanism configured and arranged to push a pressure-receiving plate and a peripheral part of the flexible member around the pressure-receiving plate, the pushing mechanism being configured and arranged to contain air, the pressure-receiving plate being provided on a center portion of the flexible member; and a control unit configured to switch between operating in a releasing mode for pushing the peripheral part and the pressure-receiving plate by the pushing mechanism to forcibly open the valve in a blocking state where the valve blocks the connecting passage, and a blocking mode for releasing the peripheral part and the pressure-receiving plate from being pushed by the pushing mechanism to close the valve.

2. The liquid feed valve unit according to claim 1, wherein the pushing mechanism has an expansion and contraction mechanism configured and arranged to expand and contract, and to push the peripheral part and the pressure-receiving plate in an expanded state, and the control unit is configured to cause the expansion and contraction mechanism to expand to implement the releasing mode, and to cause the expansion and contraction mechanism to contract to implement the blocking mode.

3. The liquid feed valve unit according to claim 1, wherein the pushing mechanism has a pressure adjustment chamber surrounded by a wall part so as to be adjacent to the peripheral part and the pressure-receiving plate, and a pressure adjustment part configured and arranged to adjust a pressure in the pressure adjustment chamber, and the control unit is configured to control the pressure adjustment part to switch between the releasing mode and the blocking mode.

4. A liquid ejection device comprising:

the liquid feed valve unit according to claim 1, and configured and arranged to feed the liquid to the liquid ejection head; and the liquid ejection head configured and arranged to eject the liquid.

5. The liquid ejection device according to claim 4, further comprising a device control unit configured and arranged to switch between performing an ejection operation for ejecting the liquid from the liquid ejection head and an adjustment operation for adjusting an ejection state of the liquid ejection head, the device control unit serving as the control unit of the liquid feed valve unit.

6. The liquid ejection device according to claim 5, wherein the device control unit implements the releasing mode in the liquid feed valve unit in a case in which an inside portion of the liquid ejection head is pressurized and the liquid is discharged as the adjustment operation.

7. The liquid ejection device according to claim 5, wherein the device control unit implements the blocking mode in the liquid feed valve unit in a case in which an inside portion of the liquid ejection head is suctioned and the liquid is discharged as the adjustment operation.

8. A liquid ejection device comprising:

the liquid feed valve unit according to claim 2, and configured and arranged to feed the liquid to the liquid ejection head; and the liquid ejection head configured and arranged to eject the liquid.

9. The liquid ejection device according to claim 8, further comprising a device control unit configured and arranged to switch between performing an ejection operation for ejecting the liquid from the liquid ejection head and an adjustment operation for adjusting an ejection state of the liquid ejection head, the device control unit serving as the control unit of the liquid feed valve unit.

10. The liquid ejection device according to claim 9, wherein the device control unit implements the releasing mode in the liquid feed valve unit in a case in which an inside portion of the liquid ejection head is pressurized and the liquid is discharged as the adjustment operation.

11. The liquid ejection device according to claim 9, wherein the device control unit implements the blocking mode in the liquid feed valve unit in a case in which an inside portion of the liquid ejection head is suctioned and the liquid is discharged as the adjustment operation.

12. A liquid ejection device comprising:

the liquid feed valve unit according to claim 3, and configured and arranged to feed the liquid to the liquid ejection head; and the liquid ejection head configured and arranged to eject the liquid.

13. The liquid ejection device according to claim 12, further comprising a device control unit configured and arranged to switch between performing an ejection operation for ejecting the liquid from the liquid ejection head and an adjustment operation for adjusting an ejection state of the liquid ejection head, the device control unit serving as the control unit of the liquid feed valve unit.

14. The liquid ejection device according to claim 13, wherein the device control unit implements the releasing mode in the liquid feed valve unit in a case in which an inside portion of the liquid ejection head is pressurized and the liquid is discharged as the adjustment operation.

15. The liquid ejection device according to claim 13, wherein the device control unit implements the blocking mode in the liquid feed valve unit in a case in which an inside portion of the liquid ejection head is suctioned and the liquid is discharged as the adjustment operation.

16. The liquid ejection device according to claim 1, wherein the flexible member has a first surface and a second surface opposite to the first surface, the first surface is configured to contact the liquid, and the pushing mechanism is located at a side of the atmosphere with respect to the flexible member.

17. The liquid feed valve unit according to claim 1, wherein a liquid accommodating chamber includes a first liquid accommodating section and a second liquid accommodating section, the first liquid accommodating section connects to the tube that communicates with the liquid storing part, the second liquid accommodating section connects to a flow path that communicates with the liquid ejection head, the flexible member blocks the opening of the concave part, which is defined by the second liquid accommodating section, and the flexible member flexes during the reduced-pressure state in which a pressure in the second liquid accommodating section is reduced.

18. The liquid ejection device comprising:

the liquid feed valve unit according to claim 17;

the liquid ejection head;

a pressurizing unit configured to pressure the first liquid accommodating section; and a device controller configured to switch a first mode and a second mode, the first mode being a mode in which the valves opens by flexing of the flexible member during the reduced-pressure state in which the ejecting of the liquid from the liquid ejection head causes the pressure in the second liquid accommodating section to be reduced, the second mode being a mode in which the liquid is supplied from the first liquid accommodating section to the second liquid accommodating section by pressurizing of the pressurizing unit while the valve is forcibly open by pushing of the pushing mechanism.

19. The liquid feed valve unit according to claim 1, wherein the pushing mechanism has an outer member defining a space for containing the air therein, the outer member is expandable and contractible, the pushing mechanism further has an air driving mechanism configured to supply the air for the space and remove the air from the space, and the control unit is configured to cause the air driving mechanism to supply the air to the space such that the outer member expands to push the peripheral part and the pressure-receiving plate, and to cause the air driving mechanism to remove the air from the space such that the outer member contracts to release the peripheral part and the pressure-receiving plate from being pushed.

* * * * *